US005971791A

United States Patent [19]

Itoh et al.

[11] Patent Number: 5,971,791

[45] Date of Patent: Oct. 26, 1999

[54] WATERPROOF CONNECTOR

[75] Inventors: Nozomi Itoh; Norio Takaku; Kaoru Sato, all of Omiya, Japan

[73] Assignee: Kansei Corporation, Omiya, Japan

[21] Appl. No.: 08/919,777

[22] Filed: Aug. 29, 1997

[30] Foreign Application Priority Data

| | | | |
|---|---|---|---|
| Aug. 30, 1996 | [JP] | Japan | 8-230315 |
| Aug. 30, 1996 | [JP] | Japan | 8-230316 |
| Aug. 30, 1996 | [JP] | Japan | 8-230317 |
| Aug. 30, 1996 | [JP] | Japan | 8-230318 |
| Sep. 12, 1996 | [JP] | Japan | 8-241463 |

[51] Int. Cl.[6] ..... H01R 13/627

[52] U.S. Cl. ..... 439/364; 439/559

[58] Field of Search ..... 439/559, 364, 439/557

[56] References Cited

U.S. PATENT DOCUMENTS

| | | | |
|---|---|---|---|
| 5,037,325 | 8/1991 | Wirkus | 439/557 |
| 5,112,241 | 5/1992 | Chestnut et al. | 439/559 |
| 5,139,431 | 8/1992 | Saitoh et al. | 439/364 |
| 5,266,051 | 11/1993 | Chupak | 439/559 |
| 5,743,756 | 4/1998 | Hass et al. | 439/364 |

FOREIGN PATENT DOCUMENTS

| | | | |
|---|---|---|---|
| 62-200267 | 9/1987 | Japan . | |
| 5-41078 | 6/1993 | Japan . | |
| 7-32873 | 6/1995 | Japan | 439/519 |
| 8-330019 | 12/1996 | Japan . | |
| 8-330021 | 12/1996 | Japan . | |
| 9-106849 | 4/1997 | Japan . | |

*Primary Examiner*—Michael L. Gellner
*Assistant Examiner*—Antoine Ngandjui
*Attorney, Agent, or Firm*—Foley & Lardner

[57] ABSTRACT

A pair of female and male housings 22 and 23 are inserted respectively from a front 21*a* and a rear 21*b* of an attachment panel 21 and engage each other, a housing 22 on the front 21*a* is covered with a grommet 25, the housings 22 and 23 are connected by a bolt 26 inserted from the grommet 25, and a fastening piece 27*e* separated from a cover main body 27*a* and detachably engaging the cover main body 27*a* is attached thereto, whereby the grommet 25 is covered on a peripheral end face with a grommet cover 27 so as to fasten the grommet 27.

12 Claims, 12 Drawing Sheets

WATERPROOF CONNECTOR

BACKGROUND OF THE INVENTION

1. Field of the Invention

This invention relates to a waterproof connector having a pair of male and female housings inserted from the front and the rear of an attachment panel, the housings being connected by a bolt and the front housing being covered with a grommet to make the housing waterproof.

2. Description of the Related Art

Hitherto, for example, a door panel of an automobile (attachment panel) has been provided with a waterproof connector for electrically connecting various switches provided on the door panel and a power supply, drive devices, etc., on the body of the automobile.

A waterproof connector as shown in FIGS. 10–12 is known as a waterproof connector mounted on such an automobile door panel (see Japanese Utility Model Laid-Open No. Hei 7-32873).

In FIGS. 10 and 11, a waterproof connector 2 mounted on an attachment panel 1 comprises a male housing 3 inserted from the rear of the attachment panel 1, a female housing 4 inserted from the front of the attachment panel 1, a grommet 5 covering the female housing 4, a bolt 6 being inserted from the grommet 5 side for connecting the male and female housings 3 and 4, and a grommet cover 7 covering the peripheral end face of the grommet 5 as shown in FIG. 12.

A panel engagement protrusion 3*a* is formed on one side of the male housing 3 positioned in the upper part of the car body and is engaged with a panel holder 8 disposed on one side positioned in the lower part of the car body in a state in which they penetrate the attachment panel 1, whereby the male housing 3 is temporarily held on the attachment panel 1. The male housing 3 contains a washer 9 engaging an annular groove 6*a* made in the stem of the bolt 6 for preventing the bolt 6 from being removed. As shown in FIG. 13, the type wherein a plate 10 is inserted into the male housing 3 in place of the washer 9 is also available (see Japanese Utility Model Laid-Open No. Hei 5-41078).

The female housing 4 is inserted through an opening 3*b* of the male housing 3 and the housings 4 and 3 are connected by fastening the bolt 6 penetrating a bolt penetration tube 4*a* fitted into the female housing 4.

The grommet 5 comprises a derivation part 5*a* covering the end face to the peripheral surface of the female housing 4 positioned on the front of the attachment panel 1 and a tubular part 5*b* communicating with the derivation part 5*a* for guiding a harness (not shown), the derivation part 5*a* and the tubular part 5*b* being molded in one piece made of synthetic rubber, etc.

An open end of the derivation part 5*a* comes in elastic contact with the attachment panel 1 by fastening the bolt 6, whereby a seal property to the inside of the connector is provided. The cover part 5*a* has a lip part 5*c* sandwiched between parts of the male and female housings 3 and 4 positioned in the upper part of the car body from the axial direction of the bolt 6, thereby preventing water drops traveling on the attachment panel 1 from entering the derivation part 5*a*.

The grommet cover 7 comprises a plurality of holes 7*a* engaging a plurality of protrusions 5*d* projected from the outer peripheral surface of the grommet 5. The holes 7*a* are engaged with the protrusions 5*d* so as to cover the outer peripheral surface of the grommet 5, whereby the grommet cover 7 is held on the grommet 5 and at the same time, fastens the grommet 5 from the outside, thereby providing hermeticity to the female housing 4 by the grommet 5 and preventing the grommet 5 from falling out from the female housing 4.

In the structure, a plurality of terminals (not shown) are inserted into the male housing 3, then the attachment panel 1 is temporarily held on the male housing 3, the female housing 4 is covered with the grommet 5, and the grommet 5 is covered with the grommet cover 7, then the unit is engaged with the male housing 3 for engaging the female housing 4. The bolt 6 is inserted through a bolt insertion tubular part 5*e* of the grommet 5 and is threadably engaged with a female screw member 11 disposed in the male housing 3, whereby the male and female housings 3 and 4 are coupled.

In the waterproof connector 2 of the structure as described above, the grommet 5 is covered with one grommet cover 7 and moreover fastening the grommet 5 depends only on the mold shape of both the grommet 5 and the grommet cover 7. Thus, the grommet cover 7 having an inner form smaller than the outer form of the grommet 5 must be mounted.

Therefore, the fastening accuracy does not become stable due to a mold error of the grommet 5 and the grommet cover 7; in addition, it is difficult and intricate to attach and detach the grommet cover 7 to and from the grommet 5.

In the waterproof connector 2 of the structure as described above uses a washer 9 for preventing the bolt 6 from being removed. Thus, if the bolt 6 is broken or parts are replaced accompanying an energization failure, it is hard to separate the bolt 6 from the washer 9.

Then, the plate 10 can be used in place of the washer 9. However, since the plate 10 is simply inserted into the male housing 3 (or the female housing 4), a problem occurs in plate 10 may be easily removed while the waterproof connector 2 is assembled or when the vehicle runs. In addition, a reasonable depth is required to prevent the plate 10 from being removed, causing a new problem of an increases in material costs to arise.

In the grommet cover 7 of the waterproof connector 2 of the structure as described above is the surface of the grommet 5 and the peripheral surface orthogonal to the surface (the face where a plurality of protrusions 5*d* are formed). Thus, for example, when the bolt 6 does not exist or is broken, if the pipe part 5*b* of the grommet 5 is extended unexpectedly, a part of the introduction part 5*a* of the grommet 5 peels off from the female housing 4 or the introduction part 5*a* is removed completely.

In the waterproof connector 2 of the structure as described above, when the bolt 6 is inserted in the bolt insertion tubular part 5*e*, the bolt insertion tubular part 5*e* is dragged in the insertion direction of the bolt insertion tubular part 5*e* due to load in the insertion direction and a clearance easily occurs between the bolt 6 and the bolt insertion tubular part 5*e*. If the bolt 6 is rotated to couple the female and male housings 3 and 4, the bolt insertion tubular part 5*e* is twisted due to load in the rotation direction and a clearance easily occurs between the bolt 6 and the bolt insertion tubular part 5*e*.

In the waterproof connector 2 of the structure as described above, it is feared that water drops traveling on the surface of the attachment panel 2 may pass through the space between the attachment panel 2 and the grommet 5 and enter the derivation part 5*a* from between the panel engagement protrusion 3*a* and the lip part 5*c*.

SUMMARY OF THE INVENTION

The present invention has been made to solve the above problems with the conventional waterproof connector, and therefore an object of the invention is to provide a waterproof connector that stabilites of fastening accuracy and enables a grommet cover to be attached and detached easily.

Another object of the invention is to provide a waterproof connector that can easily allow the bolt to be removed as required while maintaining the removal prevention effect of the bolt and moreover can reduce the material costs.

Still, another object of the invention is to provide a waterproof connector that can prevent a grommet from peeling off or being removed from a female housing.

Yet still another object of the invention is to provide a waterproof connector that can prevent a clearance from occurring between the bolt and the grommet due to load produced with insertion or rotation of the bolt and therefore can improve the waterproof property.

Yet still another object of the invention is to provide a waterproof connector that can improve the effect of preventing water drops traveling on the attachment panel from entering the grommet.

To solve the above problems, according to a first aspect of the invention, there is provided a waterproof connector wherein a pair of female and male housings inserted respectively from the front and the rear of an attachment panel engage each other, wherein the front housing is covered with a grommet, wherein the housings are connected by a bolt inserted from the grommet, and wherein the grommet is covered on a peripheral end face with a grommet cover, characterized in that a part of the grommet cover is separated from a cover main body and the separated part engages detachably the cover main body and is attached thereto, whereby the cover main body fastens the grommet.

According to a second aspect of the invention, there is provided a waterproof connector wherein a pair of female and male housings inserted respectively from the front and the rear of an attachment panel engage each other, wherein the front housing is covered with a grommet, and wherein the housings are connected by a bolt inserted from the grommet, characterized in that an annular engagement groove is made in a stem of the bolt and that the front housing is provided pivotably with a bolt holder engaging the engagement groove for preventing the bolt from being removed.

According to a third aspect of the invention, there is provided a waterproof connector wherein a pair of female and male housings inserted respectively from the front and the rear of an attachment panel engage each other, wherein the front housing is covered with a grommet, wherein the housings are connected by a bolt inserted from the grommet, and wherein the grommet is covered on a peripheral end face and at least a part of a surface with a grommet cover, characterized in that the grommet is formed on a peripheral wall face with a plurality of grooves so that the grooves are positioned between the front of the attachment panel and the front housing and that the grommet cover is formed with tongue pieces engaging the grooves so as to sandwich a part of the front housing between the front and the rear of the grommet cover via the grommet.

According to a fourth aspect of the invention, there is provided a waterproof connector wherein a pair of female and male housings inserted respectively from the front and the rear of an attachment panel engage each other, wherein the front housing is covered with a grommet, and wherein a bolt inserted from the grommet is threadably engaged in the rear housing with the bolt penetrating the front housing, thereby coupling the female and male housings, characterized in that the front housing is formed with a cone-shaped guide wall communicating with the penetration portion of the bolt and being inclined in a direction opened wider toward the front, that the grommet is formed with a tubular part through which the bolt penetrates, and that the tip of the tubular part is sandwiched between a stem of the bolt and the guide wall.

According to a fifth aspect of the invention, there is provided a waterproof connector wherein a pair of female and male housings inserted respectively from the front and the rear of an attachment panel engage each other, wherein the front housing is covered with a grommet, and wherein the housings are connected by a bolt inserted from the grommet, characterized in that the front housing is formed at the top with an overhang part, that the rear housing is formed at the top with a waterproof protrusion projecting to the surface side of the attachment panel, that the grommet is provided with a turn part surrounding the overhang part and a lip part continuing from the turn part and abutting the rear of the front housing, and that when the female and male housings are coupled, the waterproof protrusion is struck against a lower part of the overhang part and the space between the female and male housings is sealed like a crank by the turn part and the lip part.

The above and other objects and features of the present invention will be more apparent from the following description taken in conjunction with the accompanying drawings.

DETAILED DESCRIPTION OF THE PREFERRED EMBODIMENTS

Now, a description will be given in more detail of a waterproof connector of preferred embodiments of the invention with reference to the accompanying drawings.

Figure 1:
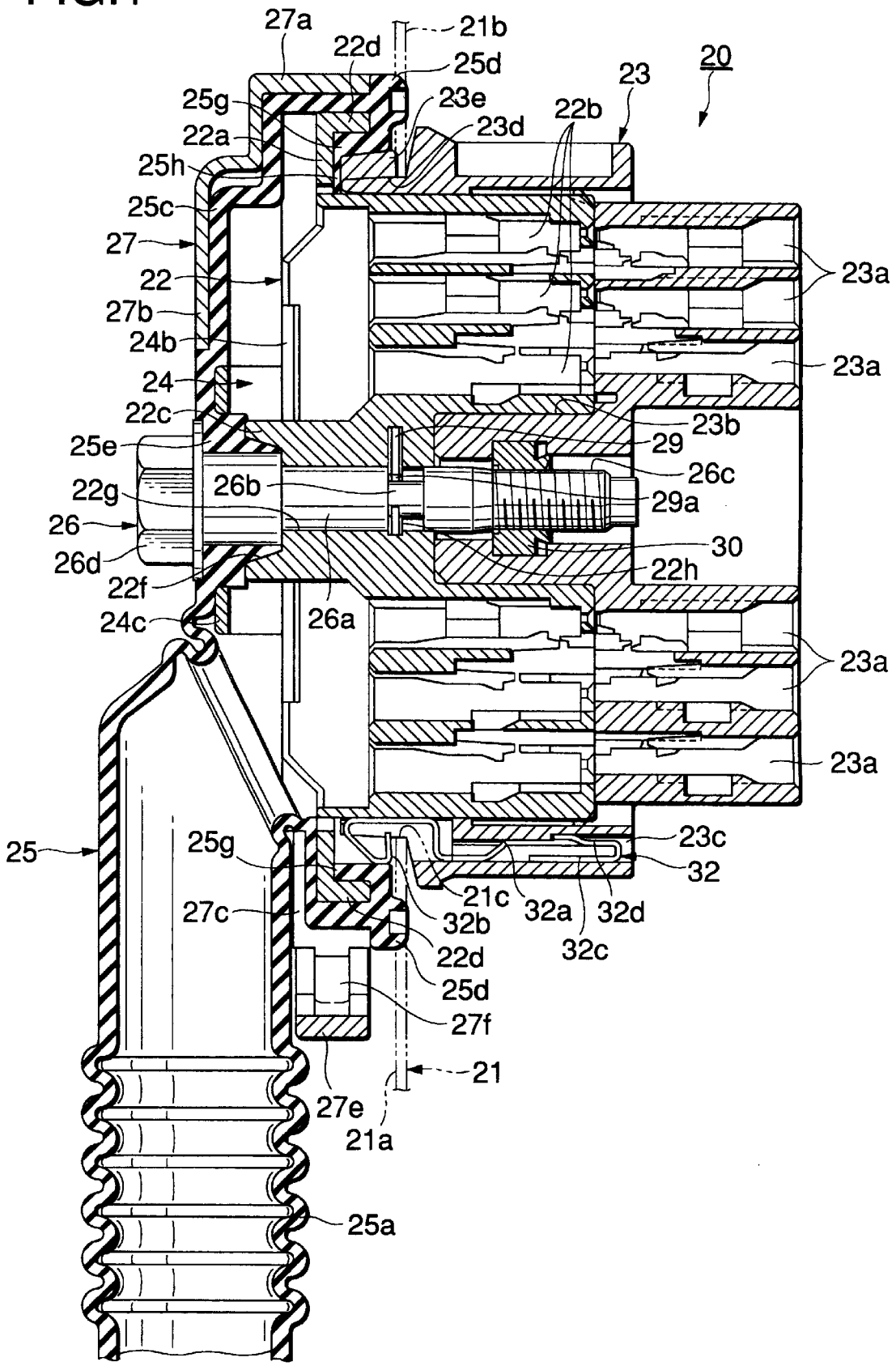
FIG. 1 shows a waterproof connector according to an embodiment of the invention and is a longitudinal sectional view of the main part of the waterproof connector.
Figure 2:
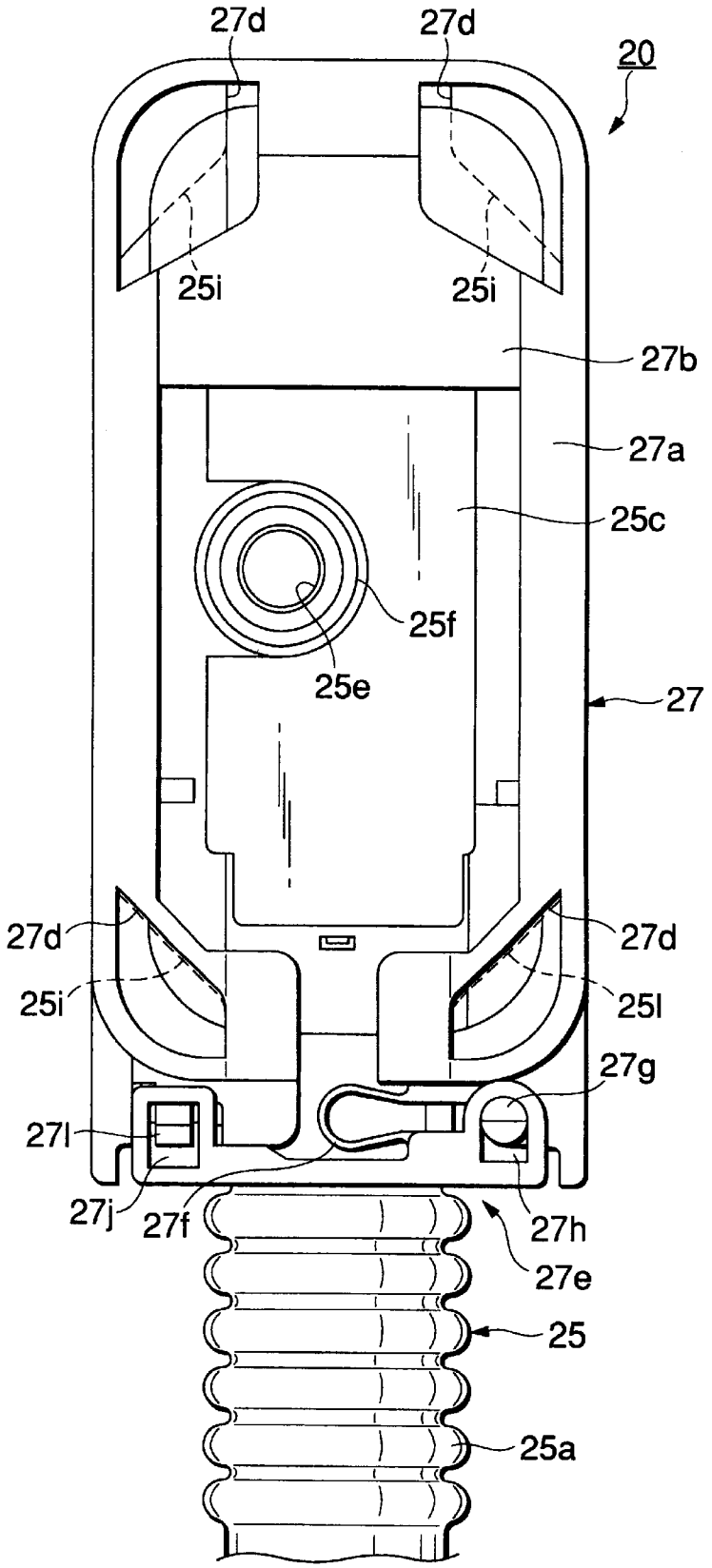
FIG. 2 is a front view of the main part of the waterproof connector.
Figure 3:
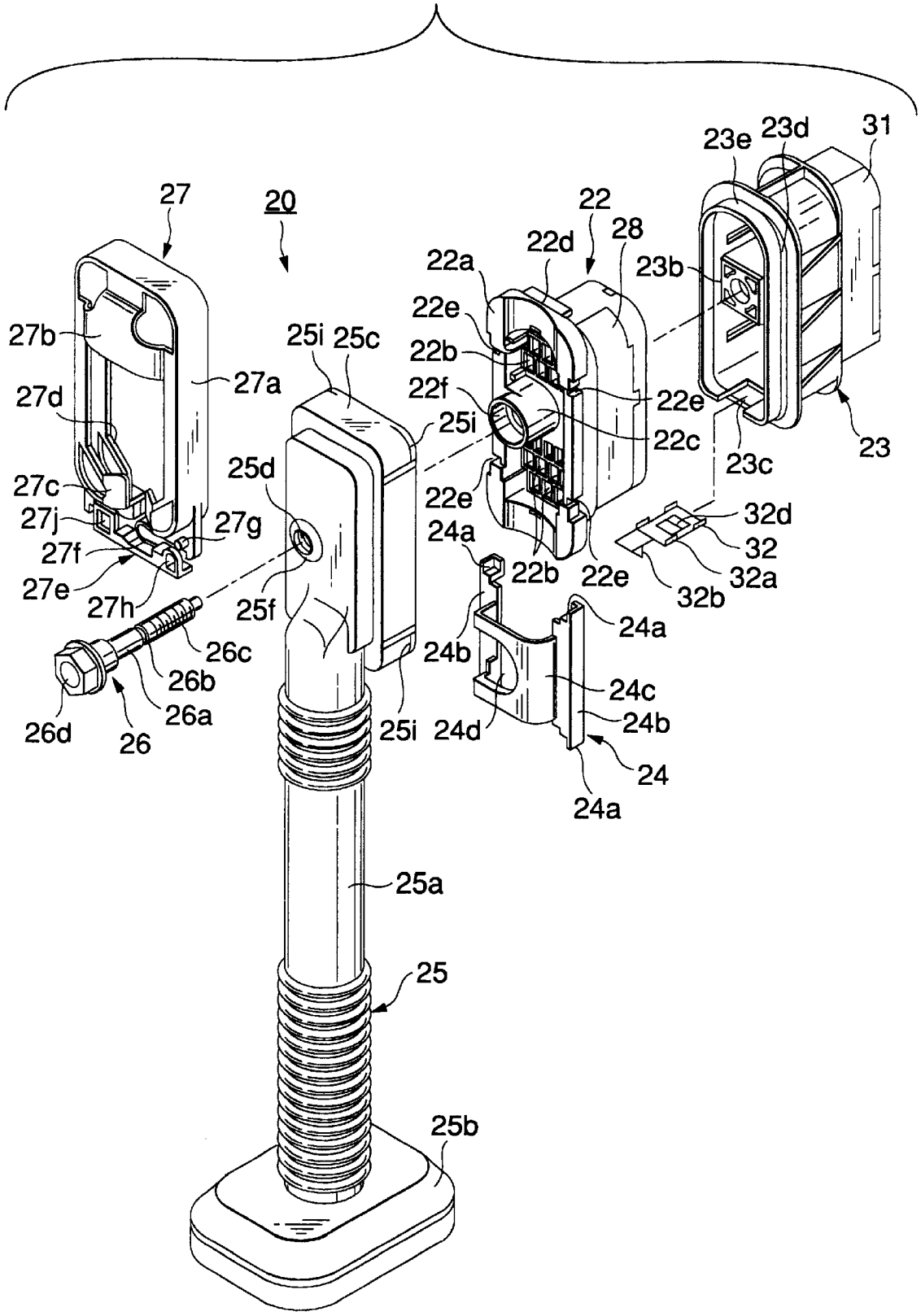
FIG. 3 is an exploded perspective view of the main part of the waterproof connector.

In FIGS. 1 to 3, a waterproof connector 20 comprises a female housing 22 inserted from a front 21*a* of an attachment panel 21 (shown only in FIG. 1), a male housing 23 inserted from a rear 21*b* of the attachment panel 21, a wire cover 24 for providing the bend state of a harness connected to terminals (not shown) held in terminal holding holes 22*b* of the female housing 22 when the harness is mounted on the female housing 22 between the wire cover 24 and the female housing 22, a grommet 25 for covering a flange part 22*a* of the female housing 22, a bolt 26 being inserted from the grommet 25 for connecting the female and male housings 22 and 23, and a grommet cover 27 fitted into the grommet 25.

The attachment panel 21 is, for example, a thin metal panel forming a part of a door panel of an automobile and the male housing 23 is engaged in an opening 21*c* formed at a predetermined position of the attachment panel. The terms "upper (top)" and "lower (bottom)" directions in this specification are used to mean the same directions as the upper (top) and lower (bottom) directions of the car body.

A female retainer 28 like comb teeth (shown only in FIG. 3) is mounted on the female housing 22. The female housing 22 is formed with a large number of terminal holding holes 22*b* penetrating from the front to the rear of the attachment panel 21 and made roughly in in-line rows and a tubular part 22*c* through which a stem 26*a* of the bolt 26 penetrates.

Terminals (not shown) of the harness (not shown) introduced from the car body side into the grommet 25 are inserted into the terminal holding holes 22*b* of the female housing 22 and the female retainer 28 is mounted in this state, thereby preventing the terminals from being removed from the terminal holding holes 22*b*.

Figure 4:
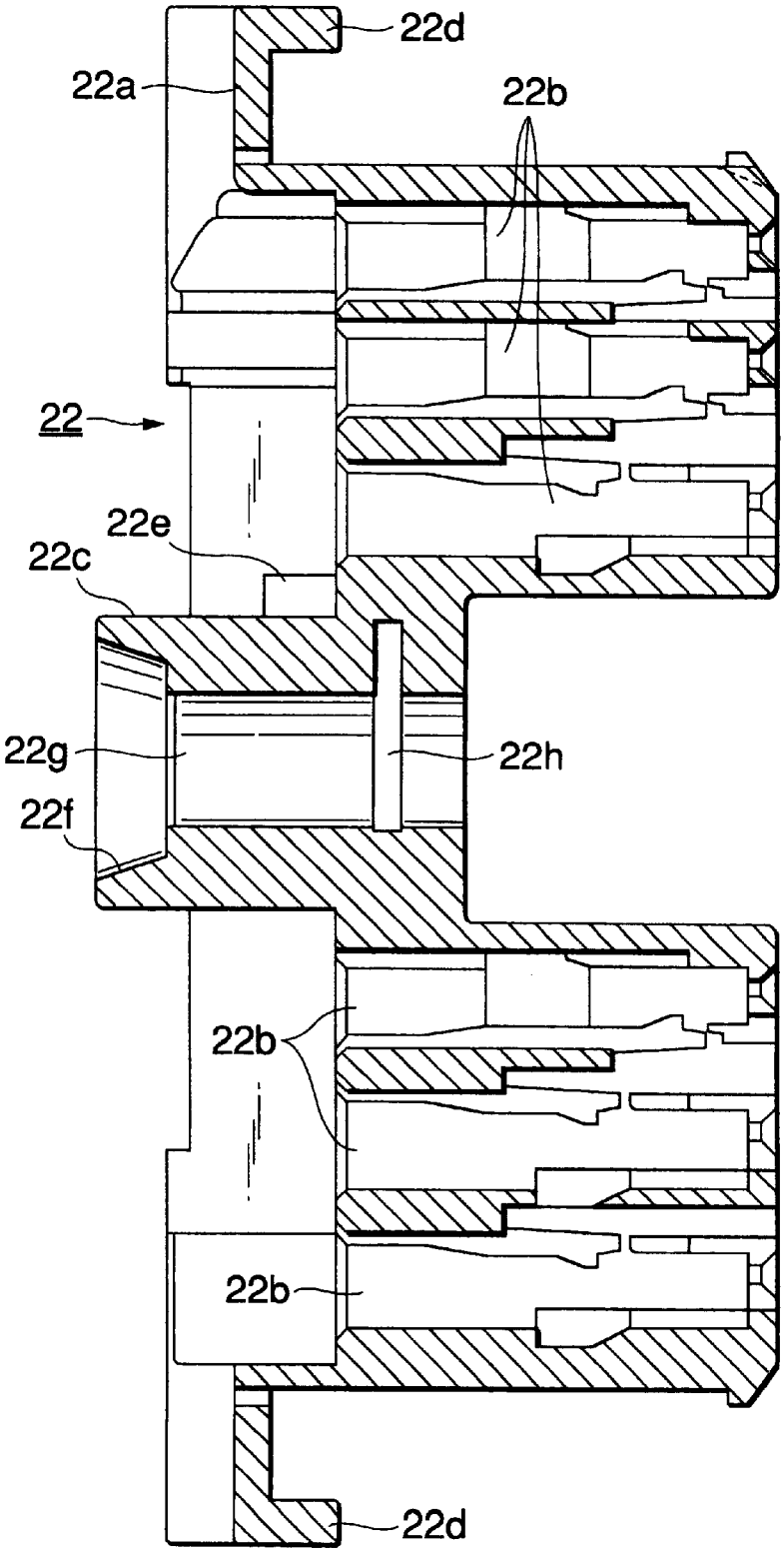
FIG. 4 is an enlarged longitudinal sectional view of a female housing of the waterproof connector.
Figure 5A:
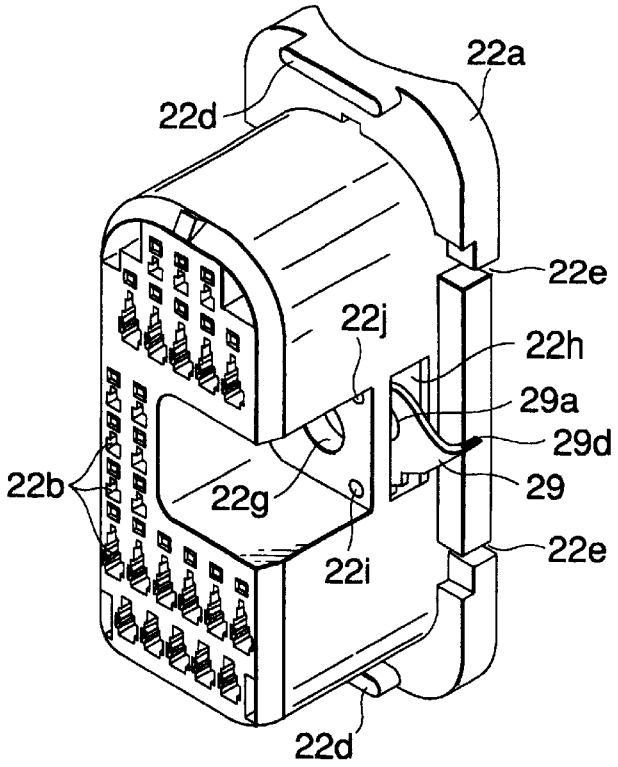
FIG. 5A is a perspective view from the rear direction of the female housing.
Figure 5B:
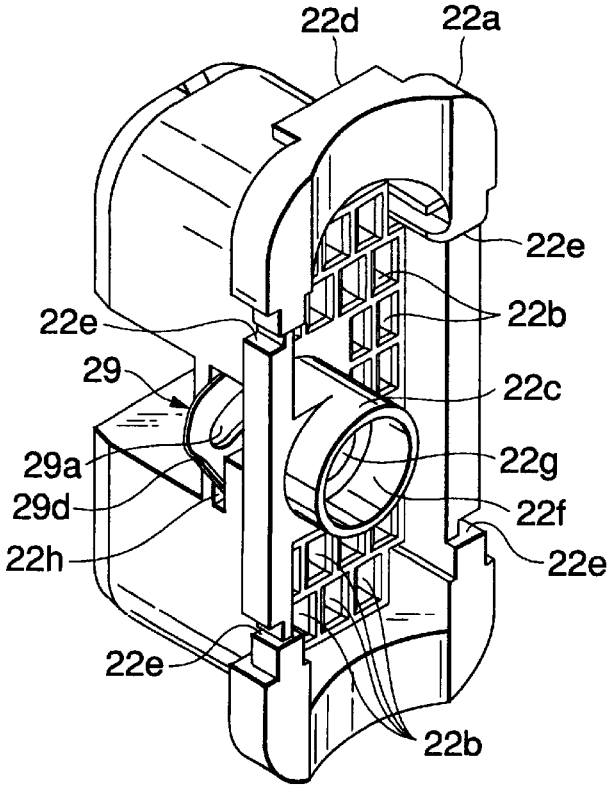
FIG. 5B is a perspective view from the front direction of the female housing.

The flange part 22*a* is formed with an overhang part 22*d* projecting from the peripheral end part of the flange part to the attachment panel 21 side, as shown in FIGS. 4 and 5A, 5B. It is also formed with engagement recesses 22*e* engaged with foot parts 24*a* of the wire cover 24, as shown in FIG. 3.

The tubular part 22*c* is formed with a conical guide wall 22*f* opened to the projection end and opened wider toward the open end of the tubular part. The guide wall 22*f* communicates with a bolt through hole 22*g* of the tubular part 22*c*. The tubular part 22*c* is formed on a side wall with a holder insertion hole 22*h* communicating with the bolt through hole 22*g*, as shown in FIGS. 1 and 4. A bolt holder 29 is fitted into the holder insertion hole 22*h* rotatably and detachably, as shown in FIGS. 5A and 5B.

Figure 6:
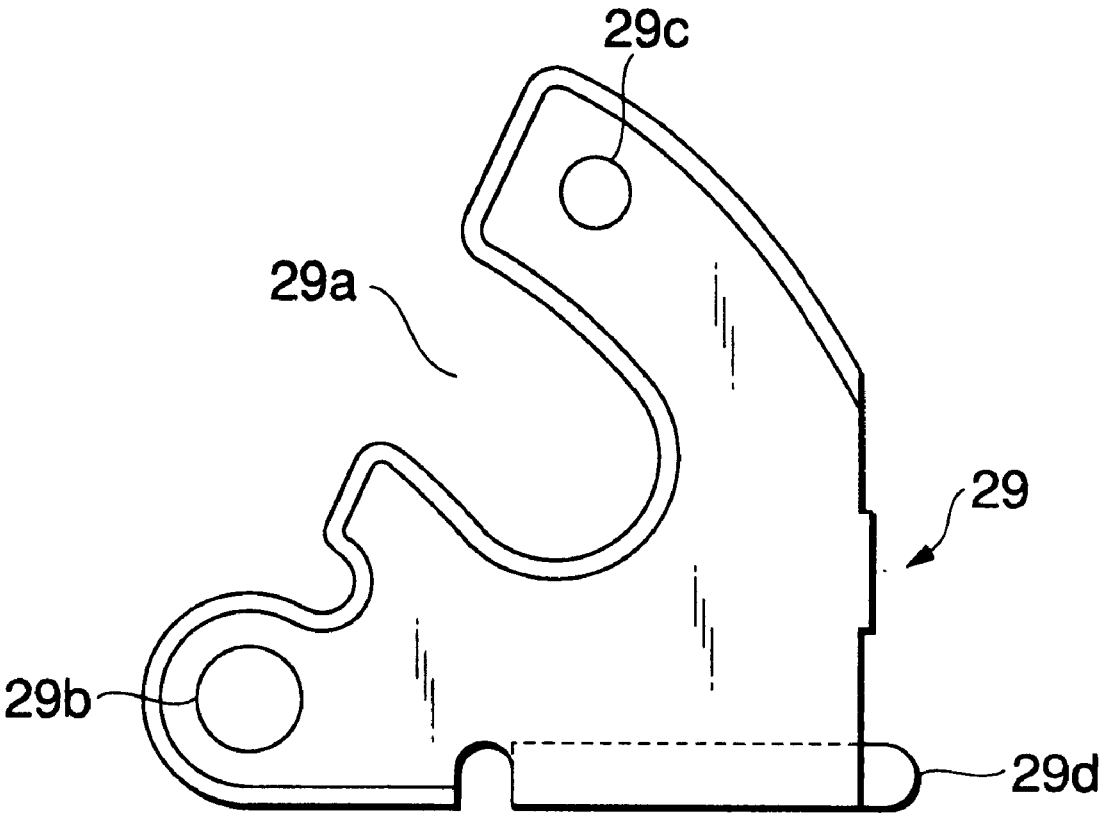
FIG. 6 is an enlarged front view of a bolt holder of the waterproof connector.

As shown in FIG. 6, the bolt holder 29 is formed with a bolt engagement recess 29*a* extending roughly like a circular arc, a rotation supporting point protrusion 29*b* engaging a hole 22*i* made in the rear face of the tubular part 22*c* (see FIG. 5A), a positioning protrusion 29*c* engaging a hole 22*j* made in the rear face of the tubular part 22*c* before insertion of the bolt 26 for positioning the bolt holder 29 (state in FIGS. 5A and 5B), and a flag part 29*d* for rotation operation, which are formed by press molding of a thin metal plate. When the bolt holder 29 is rotated with the protrusion 29*b* as a supporting point and is embedded in the female housing 22, it engages an annular groove 26*b* made in the stem 26*a* of the bolt 26 for preventing the bolt 26 from being removed and the protrusion 29*c* engages a hole (not shown) like the hole 22*j* for positioning the bolt holder 29.

Figure 7:
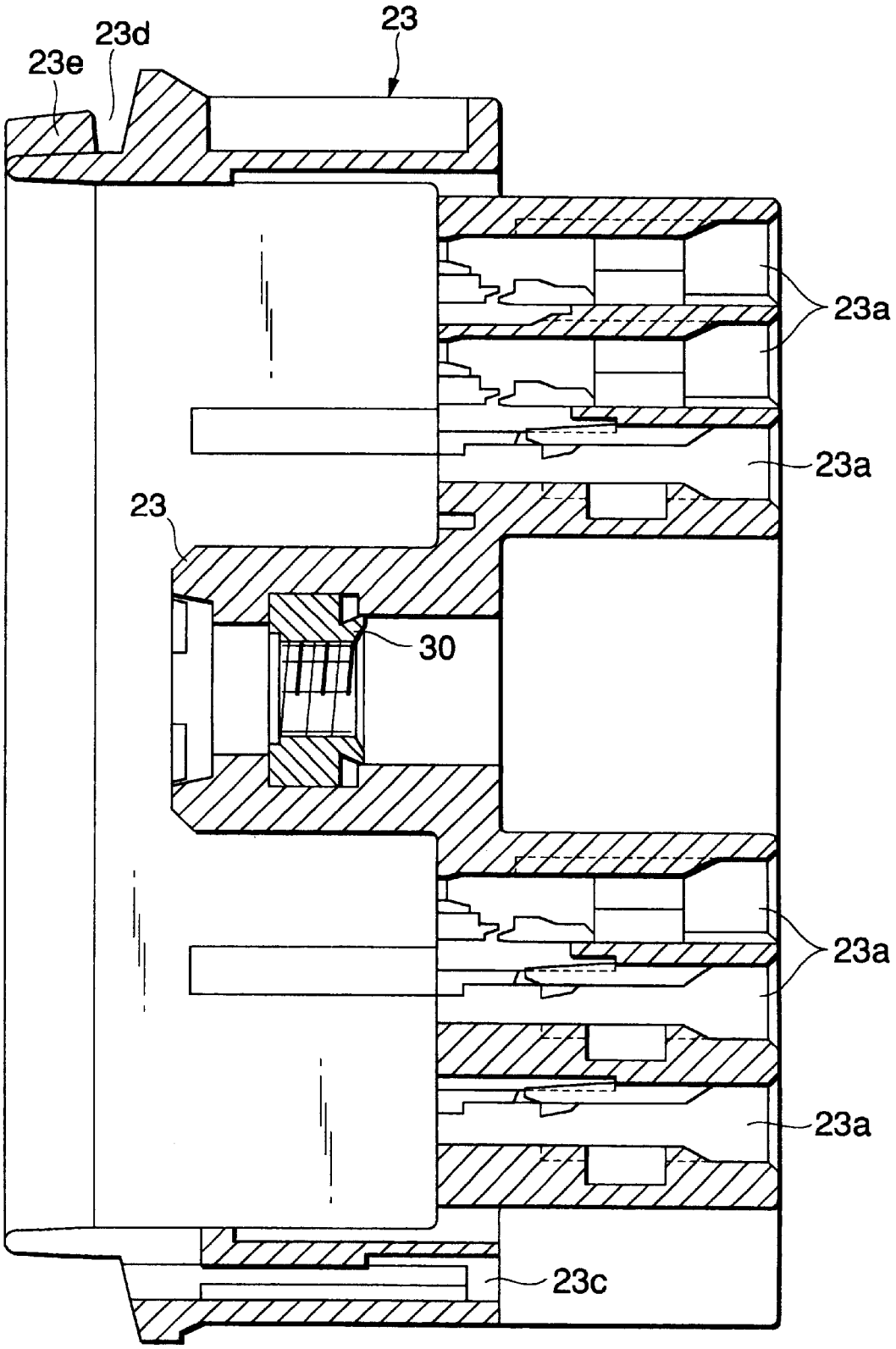
FIG. 7 is a longitudinal sectional view of a male housing of the waterproof connector.

A female screw member 30 threadably engaging a screw part 26*c* of the bolt 26 is fitted into the male housing 23 by insert molding. The male housing 23 is formed with a male retainer 31 like comb teeth (shown only in FIG. 3) engaging the male housing 23 for preventing terminals from being removed and a panel holder 32 engaging the lower part of the opening 21*c*. The male retainer 31, which is similar to a mall retainer shown in Japanese Utility Model Laid-Open No. Sho 62-200267, will not be discussed here in detail. The male housing 23 is formed with a large number of terminal holding holes 23*a* penetrating the male housing 23 from the front to the rear and made roughly in in-line rows, a protrusion 23*b* into which the screw part 26*c* of the bolt 26 is inserted, a hole 23*c* into which the panel holder 32 is fitted detachably as shown in FIG. 4, an engagement groove 23*d* engaging the upper part of the opening 21*c* of the attachment panel 21, and a waterproof protrusion 23*e* positioned on the front 21*a* side of the attachment panel 21 when the engagement groove 23*d* engages the opening 21*c*, as shown in FIG. 7.

The terminals (not shown) of the harness (not shown) connected to various switches and a drive system disposed on the door panel are inserted into the terminal holding holes 23*a* of the male housing 23 and the male retainer 31 is mounted in this state, thereby preventing the terminals from being removed. The terminal holding holes 23*a* are opposed to the terminal holding holes 22*b*.

The wire cover 24 comprises a pair of pillar parts 24*b* and 24*b* each formed with foot parts 24*a* and 24*a* at both upper and lower ends, a support wall part 24*c* disposed between the pillar parts 24*b* and 24*b*, and a recess 24*d* made in the support wall part 24*c* through which the tubular part 22*c* penetrates, as shown in FIG. 3. The wire cover 24 is mounted on the female housing 22 via the foot parts 24*a* and 24*a*, whereby the harness is bent and held between both ends.

Figure 8A:
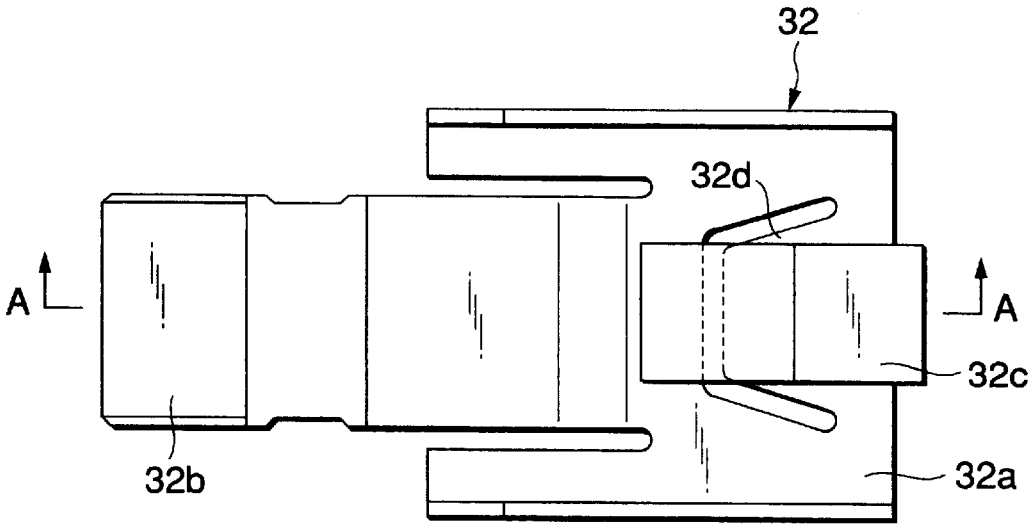
FIG. 8A is an enlarged plan view of a panel holder of the waterproof connector.
Figure 8B:
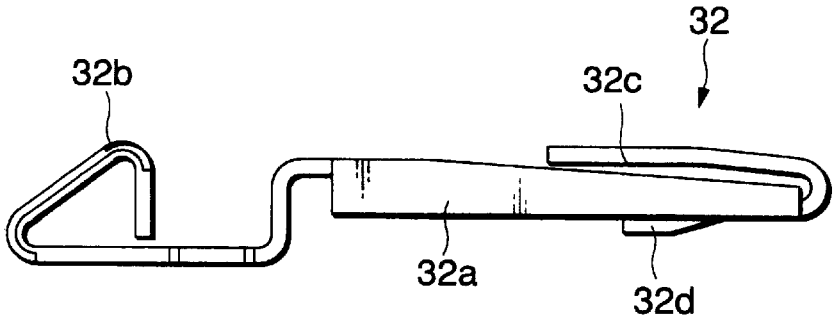
FIG. 8B is an enlarged side view of the panel holder.
Figure 8C:
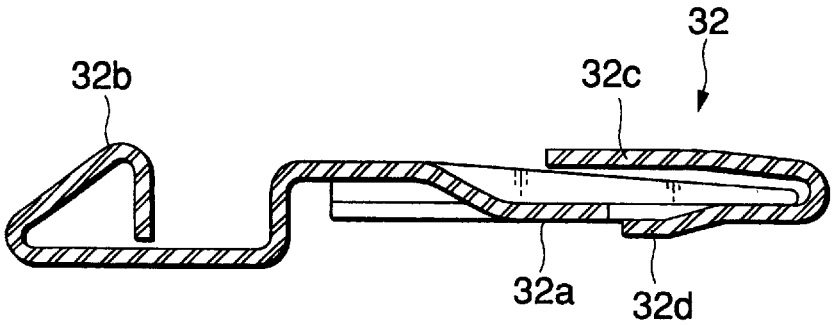
FIG. 8C is an enlarged sectional view of the panel holder taken on line A—A in FIG. 8A.

As shown in FIGS. 8A to 8C, the panel holder 32 comprises a seat 32*a*, an engagement protrusion 32*b* projecting from the male housing 23 and engaging the attachment panel 21, and a pair of plate springs 32*c* and 32*c* energized in directions going away from each other so as to come in elastic contact with the inner wall face of the hole 23*c* for preventing the play of the panel holder 32, the components being formed in one piece. The panel holder 32 is fitted detachably into the hole 23*c* of the male housing 23.

The grommet 25 comprises a pipe part 25*a* shaped like bellows in a part or on the full length, an introduction part 25*b* positioned at one end (car body side) and integral with the pipe part 25*a*, and a derivation part 25*c* positioned at the other end (attachment panel 21 side) and integral with the pipe part 25*a*, as shown in FIGS. 1 and 2; a large number of harnesses drawn out from the car body are inserted into the pipe part 25*a* from the introduction part 25*b* and are drawn out from the derivation part 25*c*, whereby the harnesses are protected and the seal property between the car body and the attachment panel 21 is provided.

The derivation part 25*c* comprises a seal part 25*d* along the open peripheral margin and abutting the front 21*a* of the attachment panel 21, a tubular part 25*e* through which the stem 26*a* of the bolt 26 penetrates, a bolt seal part 25*f* projected along the axial direction of the bolt 26 so as to surround the tubular part 25*e* and abutting a head 26*d* of the bolt 26, a turn part 25*g* extended from the seal part 25*d* and surrounding the overhang part 22*d* in the cross section direction at the point in time fitting into the female housing 22, a lip part 25*h* extended downward from the tip of the turn part 25*b* positioned upward, and groove-like recesses 25*i* made at corners positioned in the proximity of the seal part 25*d*.

The grommet cover 27 is made of a rigid resin material and shows roughly a rectangular shape on a front view as a whole. It comprises a cover main body 27*a* abutting the upper and left and right peripheral wall faces of the derivation part 25*c* and a fastening piece 27*e* engaging both ends of the cover main body 27*a* for abutting the lower part of the derivation part 25*c* and making both ends of the cover main body 27*a* approach each other, as shown in FIGS. 2 and 3.

The cover main body 27*a* is formed with an upper surface abutment part 27*b* abutting the upper surface of the derivation part 25*c*, lower surface abutment parts 27*c* and 27*c* abutting the lower surface of the derivation part 25*c* from between the pipe part 25*a* and the derivation part 25*c*, and tongue pieces 27*d* fitted into the recesses 25*i*.

The fastening piece 27*e* is connected to one end of the cover main body 27*a* by a thin piece 27*f* and comprises a stem engagement part 27*h* engaging a stem 27*g* formed at the one end and a connection part 27*j* engaging a connection protrusion 27*i* formed at the other end of the cover main body 27*a*.

In the structure, the terminals of the door panel (not shown) are inserted into the male housing 23, then the male retainer 31 and the panel holder 32 are mounted on the male housing 23 and the male housing 23 is assembled.

Next, the harness derived from the car body is inserted into the pipe part 25*a* through the introduction part 25*b* and is drawn out from the derivation part 25*c* and the terminals at the harness tip are inserted into the female housing 22, then the wire cover 24 is mounted on the female housing 22 and the bolt holder 29 is fitted into the holder insertion hole 22*h*, as shown in FIG. 1. Assume that the bolt holder 29 in this state does not engage the bolt 26, namely, is in the state shown in FIGS. 5A and 5B.

Figure 9A:
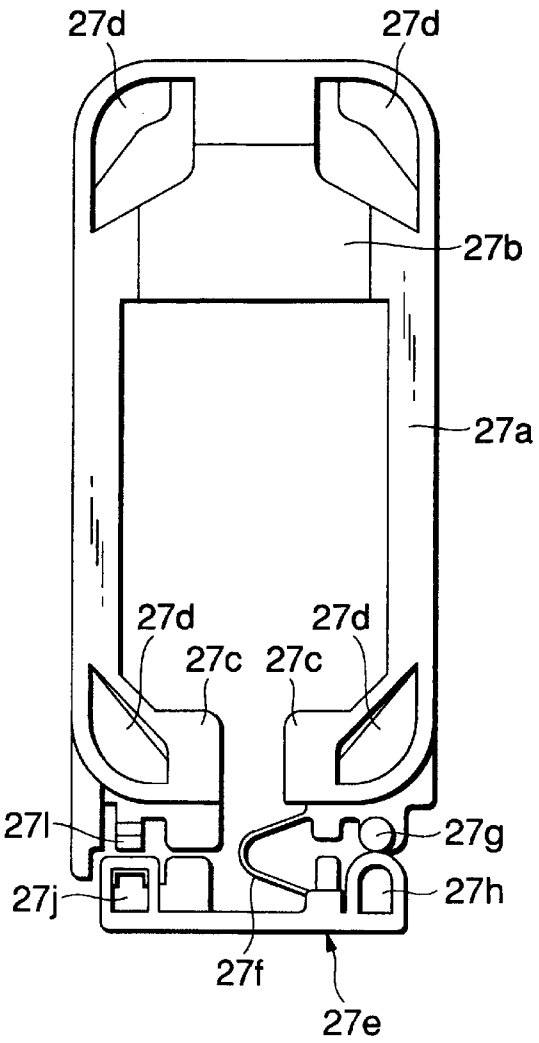
FIG. 9A is a plan view of a grommet cover of the waterproof connector.
Figure 9B:
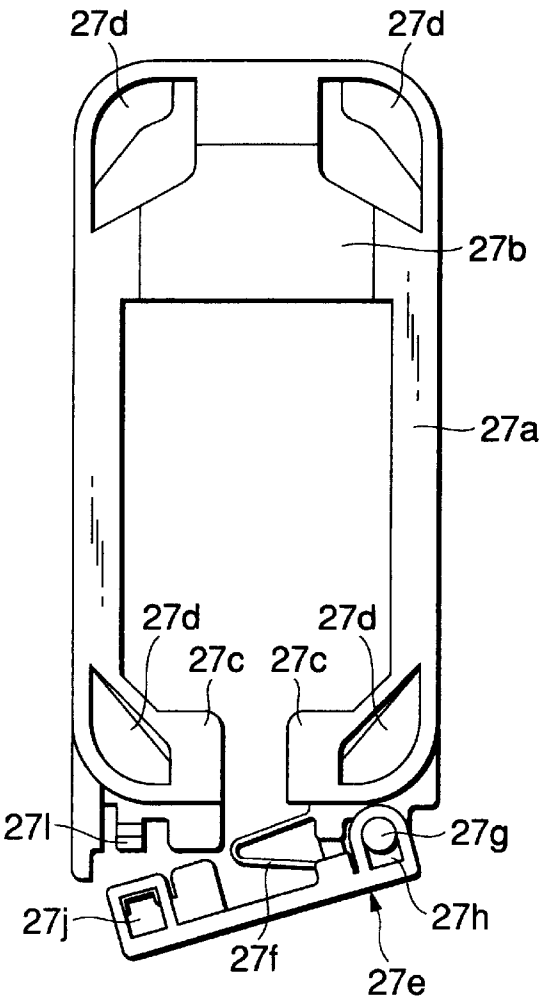
FIG. 9B is a side view of the grommet cover.
Figure 9C:
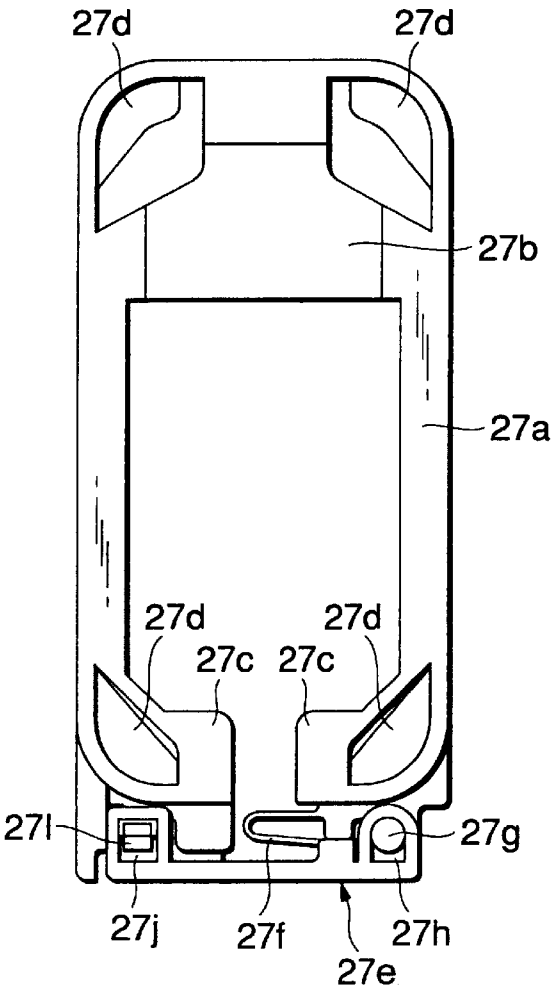
FIG. 9C is a sectional view of the grommet cover.
Figure 10:
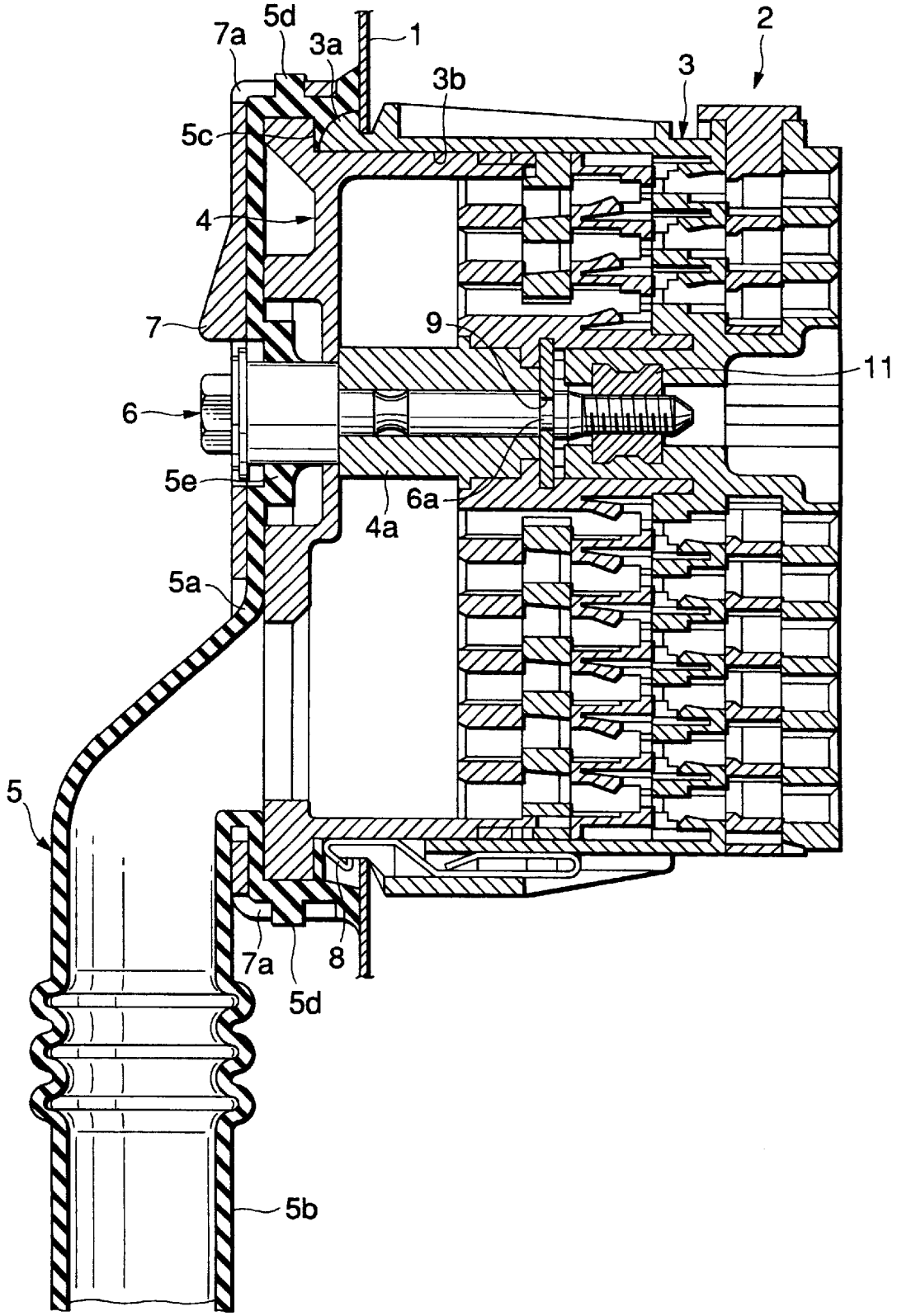
FIG.10 PRIOR ART
FIG. 10 shows a conventional waterproof connector and is a longitudinal sectional view of the main part of the waterproof connector.
Figure 11:
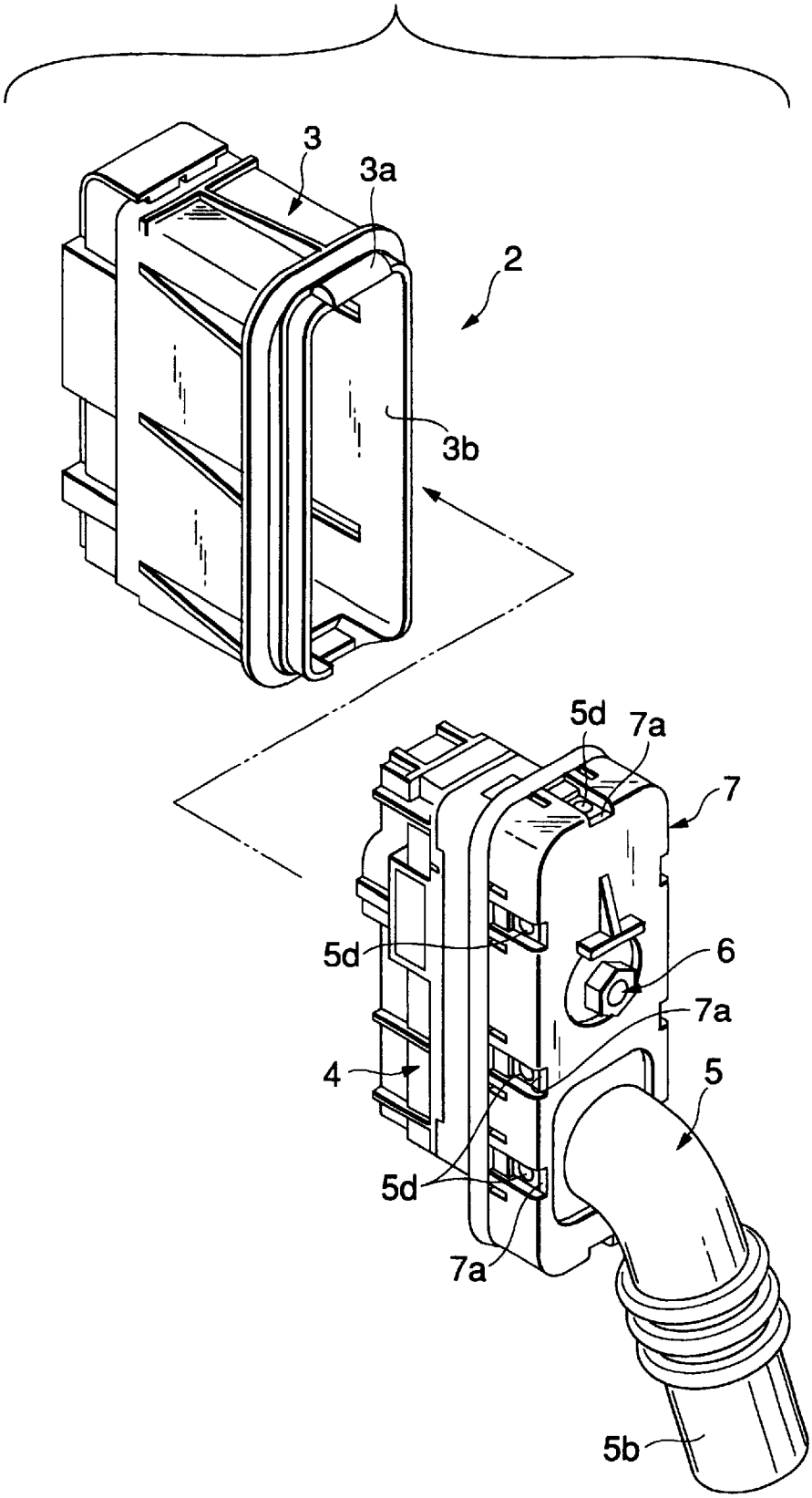
FIG.11 PRIOR ART
FIG. 11 is an exploded perspective view of the main part of the conventional waterproof connector.
Figure 12:
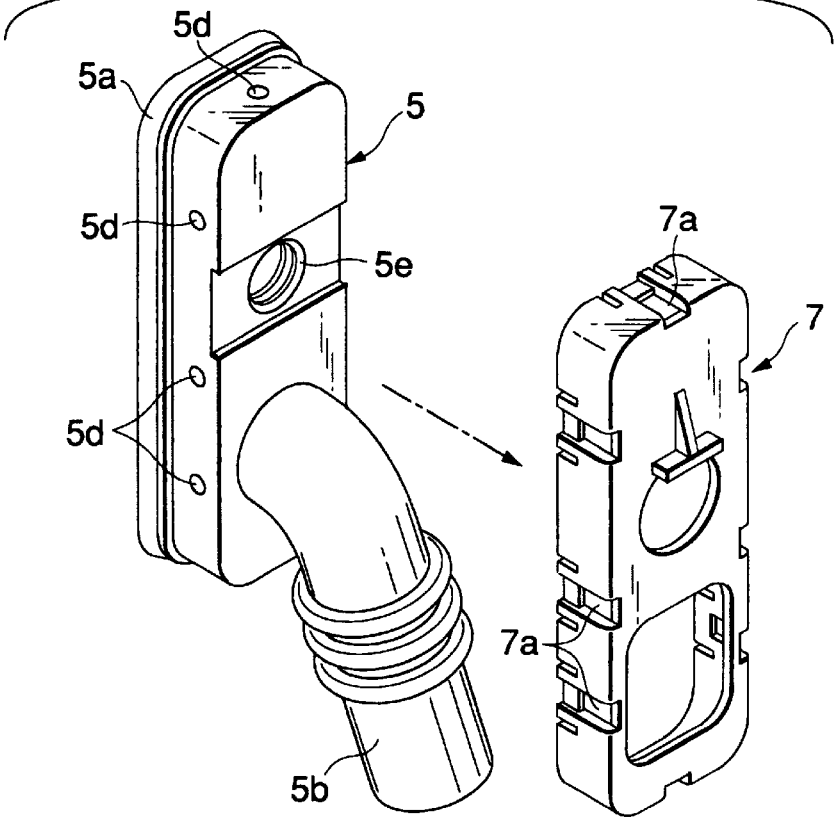
FIG.12 PRIOR ART
FIG. 12 is an exploded perspective view to show the relationship between a grommet and a grommet cover of the conventional waterproof connector.
Figure 13:
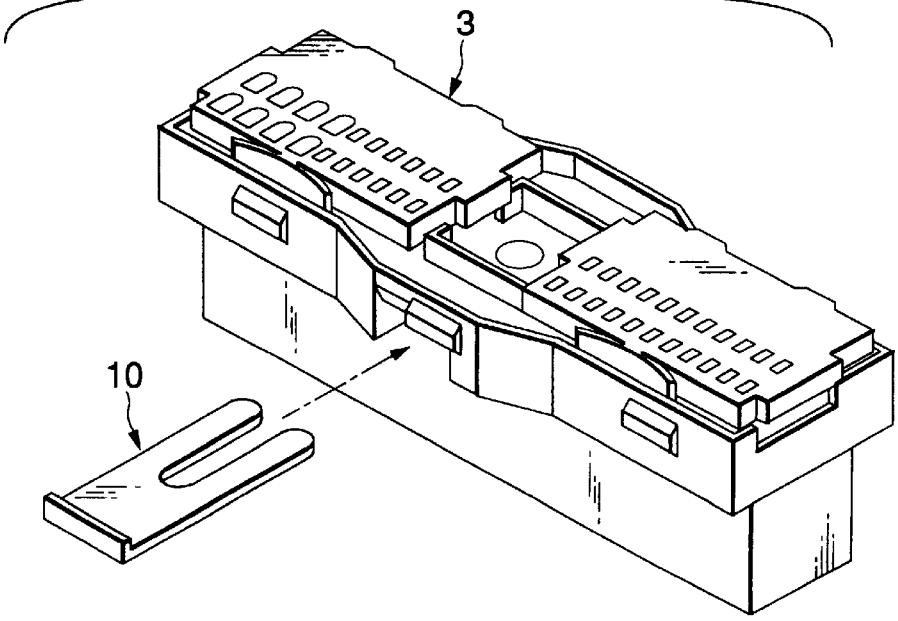
FIG.13 PRIOR ART
FIG. 13 is an exploded perspective view of the main part to show a conventional waterproof connector having a bolt removal prevention plate disposed in a housing.

The derivation part 25*c* of the grommet 25 is attached to the flange part 22*a* of the female housing 22 and the tongue parts 27*d* of the grommet cover 27 are fitted into the recesses 25*i*, then the stem engagement part 27*h* is engaged in the step 27*g* and the connection part 27*j* is engaged in the connection protrusion 27*i*, as shown in FIGS. 9A, 9B and 9C, for mounting the grommet cover 27 on the derivation part 25*c*.

At the time, the grommet cover 27 is inserted from above the grommet 25 while both ends of the grommet cover 27 are being widened, and the upper tongue parts 27*d* are fitted into the recesses 25*i* from the top to the bottom. Then, while both ends are made to approach each other, the lower tongue parts 27*d* are fitted into the recesses 25*i* from the side of the grommet 25, and the fastening piece 27*e* is engaged in both ends.

Therefore, the grommet cover 27, which sandwiches the female housing 22 between the front and rear of the grommet cover 27 via the grommet 25, can be easily attached to and detached from the derivation part 25*c*; although the grommet cover 27 is one piece like the conventional grommet cover 7, the operability of attachment and detachment of the grommet cover 27 is improved. The cover main body 27*a* is fastened as the fastening piece 27*e* is mounted, so that the fastening accuracy of the grommet cover 27 can be stabilized regardless of a molding error of the grommet 25 or the grommet cover 27.

Further, as shown in FIGS. 2 and 3, the tongue parts 27*d* are fitted into the recesses 25*i* thereby preventing the grommet cover 27 from falling out from the grommet 25. In addition, the flange part 22*a* of the female housing 22 and the grommet 25 are sandwiched between the front and the rear in conjunction with the abutment parts 27*b* and 27*c*, so that the derivation part 25*c* can also be prevented from peeling off or being removed from the female housing 22. The recesses 25*i* are not openings provided by cutting the grommet 25 and are engagement recesses for surrounding the four corners of the flange part 22*a* of the male housing 22.

Next, the bolt 26 is inserted into the tubular part 25*e* from the surface, then the bolt holder 29 is rotated for engaging the bolt engagement recess 29*a* in the annuler groove 26*b* of the bolt 26, thereby preventing the bolt 26 from being removed. The annular groove 26*b* has a predetermined width for allowing displacement along the axis of the bolt 26 because the bolt 26 is fastened subsequently.

At the time, the bolt holder 29 rotates with the protrusion 29*b* shown in FIG. 6 as a support point, thus the rotation support point maintains a given position and the bolt holder 29 is operated easily and stably; moreover, it is small and can be reduced in material cost as compared with the conventional plate 10.

As shown in FIG. 1, the male housing 23 is inserted from the rear 21*b* of the attachment panel 21 so that the waterproof protrusion 23*e* and the panel holder 32 project from the opening 21*c* of the attachment panel 21 to the front 21*a*, and the male housing 23 is temporarily held on the attachment panel 21. Then, the female housing 22 is inserted from the front 21*a* of the attachment panel 21 and is engaged in the male housing 23.

Further, the screw part 26*c* is threadably engaged in the female screw member 30, thereby coupling the female housing 22 and the male housing 23 and at the same time, electrically connecting the terminals of the female housing 22 and those of the male housing 23.

At the time, the inner wall face of the derivation part 25*c* abuts the support wall part 24*c*, thereby restricting the fastening amount and the deep displacement amount of the bolt 26 and providing the intimate contact state between the head 26*d* and the bolt seal part 25*f*.

As the bolt 26 is fastened, the female and male housings 22 and 23 approach each other, whereby the seal part 25*d* comes in intimate contact with the attachment panel 21, providing a seal property. Moreover, the turn part 25*g* is sandwiched between the overhang part 22*d* and the waterproof protrusion 23*e* and the lip part 25*h* is sandwiched between the flange part 22*a* and the waterproof protrusion 23*e*, thereby defining a waterproof passage shaped like a crank, whereby the hermeticity of water drops propagating from the top to the attachment panel 21 to the derivation part 25*c* is provided.

Further, as the bolt 26 is fastened, the load in the rotation direction of the bolt 26 occurs in the tubular part 25*e* and acts as if the tubular part 25*e* were twisted. However, the tip of the tubular part 25*e* is inserted in the guide wall 22*f* and because the guide wall 22*f* is cone-shaped, the tubular part 25*e* is gradually brought into intimate contact with the stem 26*a* side at the same time as the bolt 26 is fastened. Thus, a clearance produced accompanying occurrence of twist as the bolt 26 is rotated does not occur between the stem 26*a* and the tubular part 25*e*, and water drops are prevented from entering the derivation part 25*c* from the head 26*d* of the bolt 26. The base of the tubular part 25*e* is sandwiched between the head 26*d* and the tip of the tubular part 22*b*, whereby the whole twist action of the tubular part 25*e* can be suppressed.

As we have discussed, in the waterproof connector of the invention, a part of the grommet cover is separated from the cover main body and the separated part engages detachably the cover main body and is attached to the cover main body, whereby the cover main body fastens the grommet, so that stabilization of the fastening accuracy can be realized and moreover the grommet cover can be attached and detached easily.

As we have discussed, in the waterproof connector of the invention, the annular engagement groove is made in the stem of the bolt and the front housing is provided pivotably with the bolt holder engaging the engagement groove for preventing the bolt from being removed, whereby removal of the bolt can be easily allowed as required while the removal prevention effect of the bolt is maintained, and moreover the material costs can be reduced.

As we have discussed, in the waterproof connector of the invention, the grommet is formed on the peripheral wall face with a plurality of grooves so that the grooves are positioned between the front of the attachment panel and the front housing and the grommet cover is formed with the tongue pieces engaging the grooves so as to sandwich a part of the front housing between the front and the rear of the grommet cover via the grommet, whereby the grommet can be prevented from peeling off or being removed from the female housing.

As we have discussed, in the waterproof connector of the invention, the front housing is formed with the cone-shaped guide wall communicating with the penetration portion of the bolt and being inclined in the direction opened wider toward the front, the grommet is formed with the tubular part through which the bolt penetrates, and the tip of the tubular part is sandwiched between the stem of the bolt and the guide wall, so that a clearance can be prevented from occurring between the bolt and the grommet due to the load produced with insertion or rotation of the bolt and therefore the waterproof property can be improved As we have discussed, in the waterproof connector of the invention, the front housing is formed at the top with an overhang part, the rear housing is formed at the top with a waterproof protrusion projecting to the surface side of the attachment panel, the grommet is provided with a turn part surrounding the overhang part and a lip part continuing from the turn part and abutting the rear of the front housing, and when the female and male housings are coupled, the waterproof protrusion is struck against a lower part of the overhang part and the space between the female and male housings is sealed like a crank by the turn part and the lip part, whereby the effect of preventing water drops traveling on the attachment panel from entering the grommet can be improved.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A waterproof connector comprising:

a pair of front and rear housings which are adapted to be inserted from a front end and a rear end of an attachment panel, respectively, and engaged with each other;

a grommet with which said front housing is covered;

a bolt inserted through said grommet for connecting said front and rear housings to each other; and a grommet cover with which a peripheral end face of said grommet is covered, said grommet cover including:

a cover main body; and a fastening piece, wherein said main body is detachably engaged with said fastening piece so that said cover main body and said fastening piece fasten said grommet.

2. The waterproof connector as claimed in claim 1, wherein one end of said part of said grommet cover is pivotally detachably supported on said cover main body, and after said part of said grommet cover is rotated with the one end of said part of said grommet cover as a rotation fulcrum, an opposite end of said part of said grommet cover is engaged with said cover main body.

3. The waterproof connector as claimed in claim 1, wherein said part of said grommet cover is connected to said cover main body via a thin piece.

4. A waterproof connector comprising:

a pair of front and rear housings which are adapted to be inserted from a front and a rear of an attachment panel, respectively, and engaged with each other;

a grommet covering said front housing;

a bolt inserted through said grommet for connecting said front and rear housings to each other, wherein said bolt has an annular engagement groove in a stem of said bolt; and a bolt holder rotatably being provided on said front housing and engaged with said engagement groove for preventing said bolt from being removed.

5. A waterproof connector as claimed in claim 4, wherein said front housing is formed with a bearing part, wherein said bolt holder is formed with a stem engaging the bearing part, and wherein said bolt holder is rotated with the stem thereof and is detachable from said front housing.

6. The waterproof connector as claimed in claim 4, wherein said front housing is formed with a positioning part for restricting positions before and after insertion of said bolt; and wherein said bolt holder is formed with a positioning protrusion which is engaged with said positioning part before and after insertion of said bolt.

7. A waterproof connector comprising:

a pair of front and rear housings which are adapted to be inserted from a front end and a rear end of an attachment panel, respectively, and engaged with each other;

a grommet covering said front housing;

a bolt inserted through said grommet for connecting said front and rear housings to each other; and a grommet cover covering a peripheral end face and a part of a surface of said grommet, wherein said a plurality of grooves are defined in a peripheral wall face of said grommet so as to be positioned between the front of said attachment panel and said front housing and wherein said grommet cover is formed with tongue pieces which are engaged with said grooves so that said grommet cover sandwiches a part of said front housing between a front and a rear of said grommet cover via said grommet.

8. The waterproof connector as claimed in claim 7, wherein said grooves are recesses extending to a center of said grommet and integral with said grommet.

9. A waterproof connector comprising:

a pair of front and rear housings which are adapted to be inserted from a front end and a rear end of an attachment panel, respectively, and engaged with each other;

a grommet covering; and a bolt inserted through said grommet for connecting said front and rear housings to each other so that said bolt is threadably engaged in said rear housing in a state where said bolt penetrates said front housing, wherein said front housing has a cone-shaped guide wall communicating with a penetration portion of said bolt and is in a direction opened wider toward the front of said attachment panel, wherein said grommet has a tubular part through which said bolt penetrates, and wherein a tip of said tubular part is sandwiched between a stem of said bolt and said guide wall.

10. A waterproof connector as claimed in claim 9, wherein said tubular part has a base sandwiched between a head of said bolt and said front housing along an axial direction of said bolt.

11. A waterproof connector comprising:

a pair of front and rear housings which are adapted to be inserted from a front end and a rear end of an attachment panel, respectively, and engaged with each other;

a grommet covering said front housing; and a bolt inserted from said grommet for connecting said front and rear housings to each other, wherein said front housing has an overhang part at its top, wherein said rear housing includes a waterproof protrusion at its top projecting to a surface side of said attachment panel, wherein said grommet is provided with a turn part surrounding said overhang part and a lip part continuing from said turn part and abutting a rear of said front housing, and wherein, when said front and rear housings are coupled, said waterproof protrusion is struck against a lower part of said overhang and a space between said front and rear housings is sealed by said turn part from said lip part.

12. The waterproof connector as claimed in claim 11, wherein a seal part abutting the surface of said attachment panel is formed in a portion positioned above said turn part of said grommet.

* * * * *